United States Patent [19]

Gilbert

[11] Patent Number: 4,703,930

[45] Date of Patent: Nov. 3, 1987

[54] CREATIVE CHALLENGE GAME

[75] Inventor: Mark L. Gilbert, Salt Lake City, Utah

[73] Assignee: Paula M. Gilbert, Salt Lake City, Utah ; a partial interest

[21] Appl. No.: 898,503

[22] Filed: Aug. 21, 1986

[51] Int. Cl.[4] ..... A63F 9/00

[52] U.S. Cl. ..... 273/1 G; 434/82

[58] Field of Search ..... 273/1 G, 6 F, 276; 434/81, 82

[56] References Cited

U.S. PATENT DOCUMENTS

| | | | |
|---|---|---|---|
| 282,990 | 8/1883 | Johnson | 273/276 |
| 1,458,508 | 6/1923 | Aiken | 434/82 |
| 1,505,803 | 8/1924 | Pylick | 434/82 |
| 3,989,242 | 11/1976 | Shankel et al. | 273/1 G |
| 4,349,197 | 9/1982 | Livick | 273/1 GF |
| 4,578,131 | 3/1986 | Hawkins, Jr. | 434/82 |
| 4,604,062 | 8/1986 | Woods | 434/81 X |

FOREIGN PATENT DOCUMENTS

| | | | |
|---|---|---|---|
| 437150 | 2/1912 | France | 434/82 |
| 274883 | 7/1951 | Switzerland | 273/1 G |

OTHER PUBLICATIONS

Reader's Digest Book of 1000 Family Games, 6-1973, pp. 125, 126; What is it; The Artist's Game.

*Primary Examiner*—Paul E. Shapiro

*Attorney, Agent, or Firm*—H. Jay Spiegel

[57] ABSTRACT

The present invention relates to a game which includes as its components a deck of cards, a bag in which the cards may be placed, a timer, a mat and at least one container of modeling clay. The game is preferably played with four or more players who are divided up into pairs. In order to play the game, players choose a card at random from the bag which card identifies an object or creature. The timer is started and the player must create the object or creature out of the modeling clay within a predetermined time period. If their partner can identify the object so created, that team scores. The game continues until each team has played a predetermined number of times whereupon the team with the most points scored is declared the winner. Other modes of player are also disclosed.

6 Claims, 3 Drawing Figures

CREATIVE CHALLENGE GAME

BACKGROUND OF THE INVENTION

The present invention relates to a game involving the creative talents of the players thereof. In the prior art, applicant knows of only one game which is even remotely related to the teachings of the present invention. U.S. Pat. No. 3,592,469 to Glass, et al. discloses a game wherein the players must cut an object out of a paper sheet within a predetermined timed period. Of course, this is quite different from the teachings of the present invention wherein the objects are molded out of modeling clay and identification of the so modeled object by the partner is required.

Accordingly, a need has developed for a new game in which the creative modeling talents of the players thereof may be used in determining the winning team.

SUMMARY OF THE INVENTION

Accordingly, the present invention has been devised so as to fill the need as expressed above. The inventive game includes the following interrelated aspects and elements:

(a) In a first aspect of the present invention, a game box is provided which includes recesses therein to carry all of the components which are necessary to play the inventive game. The game box may, if desired, include a handle for easy transport.

(b) The game includes a package of cards, preferably numbering 500 or so with each card having depicted thereon the visualization of an object or creature such as for example respectively, a skyscraper or a monkey. If desired, each card may not only include a depiction of the object or creature but might also include a word such as "skyscraper" or "monkey". The game may also include a flexible bag in which the playing cards may be placed and thereafter drawn therefrom by the players of the game.

(c) In a further aspect, the game includes a timer which may be preset for whatever time period is desired, preferably 30 seconds, a mat, preferably made of plastic, and a plurality of containers of creative material such as that which is sold under the trademark Play-Doh TM. Each of the components of the game described above may be inserted into specific recesses provided therefor in the game box described above so that the entire game may be easily transported from place to place.

(d) In playing the game, at least four players are required and are divided up into teams with two players per team. The cards are placed in the bag and the teams decide amongst themselves which team is to play first by the usual methods well known in the playing of games such as, for example, flipping of a coin, drawing of straws, throwing dice, etc. The first team chooses one player as the modeler and the other player as the player who will identify that which will be modeled in the creative material. The modeler then draws a card at random from the bag and the timer is started, whereupon the modeler begins to model the object or creature depicted on the card drawn out of the creative material. The modeler models the object of creature in the same time period, for example 30 seconds, that the other player must identify the object or creature modeled with the creative material. If the other player is able to identify that which has been modeled, that team scores one point.

(e) The process described above continues from team to team and when a team is called for a subsequent time, the roles of the partners reverse as occurs with each subsequent turn of a team. After a plurality of turns for each team has been completed or, if desired, after a predetermined total time has elapsed for the entire game, the points scored by each team are totaled and the team with the largest number of points is declared the winner. Other modes of play are set forth hereinafter.

Accordingly, it is a first object of the present invention to provide a new game wherein the creative talents of the players thereof may be exploited.

It is a further object of the present invention to provide such a game wherein the players must mold objects or creatures out of modeling material within a predetermined time period in order to score points.

It is a still further object of the present invention to provide such a game wherein the players thereof are divided into pairs which comprise teams and wherein in any given turn, one player performs the modeling and the other player is called upon to identify that which has been modeled by the teammate.

These and other objects, aspects and features of the present invention may be better understood from the following detailed description of the preferred embodiments when read in conjunction with the appended drawing figures.

SPECIFIC DESCRIPTION OF THE PREFERRED EMBODIMENTS

Figure 1:
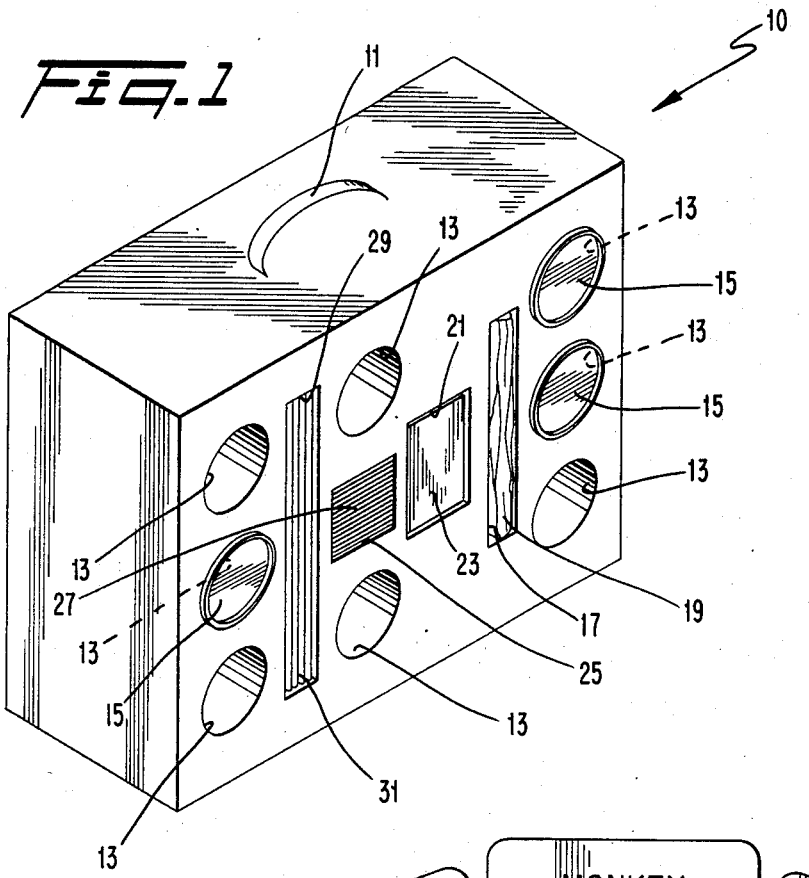
FIG. 1 shows a perspective view of the game box having the components of the game inserted into recesses formed therein.

With reference first to FIG. 1, a game box 10 is seen to be of generally rectangular cubic shape and includes a handle 11, and a plurality of recesses therein. The recesses 13 are sized to receive containers 15 of creative material such as that which is sold under the trademark Play-Doh TM. The recess 17 is sized to receive in rolled up condition a bag 19 for a purpose to be described hereinafter. The recess 21 is sized to receive therein a timing device 23 which may be adjustable to time predetermined periods of time as will be described in greater detail hereinafter.

Figure 2:
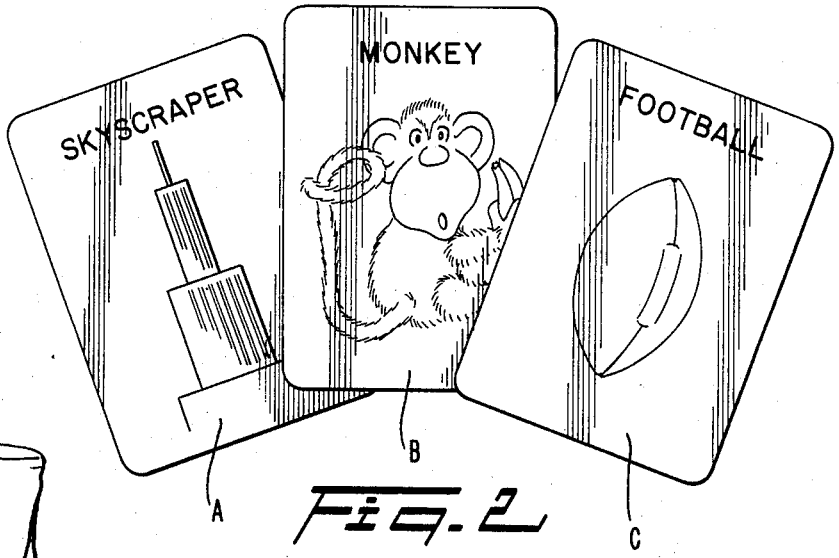
FIG. 2 shows three examples of cards which may be included in the deck of cards included in the present invention.

The recess 25 is sized to receive a deck 27 of playing cards having depicted thereon various objects or creatures which are to be modeled using the material within the containers 15. In this regard, FIG. 2 shows three examples of playing cards designated by the reference letters A, B and C. As seen in FIG. 2, the playing card A depicts a skyscraper, the playing card B depicts a monkey and the playing card C depicts a football.

With reference back to FIG. 1, it is seen that a further recess 29 is formed in the game box 10 and is sized to receive in rolled up state a mat 31, preferably made of a plastic or other flexible material which is nonimpervious to the creative material within the containers 15.

Figure 3:
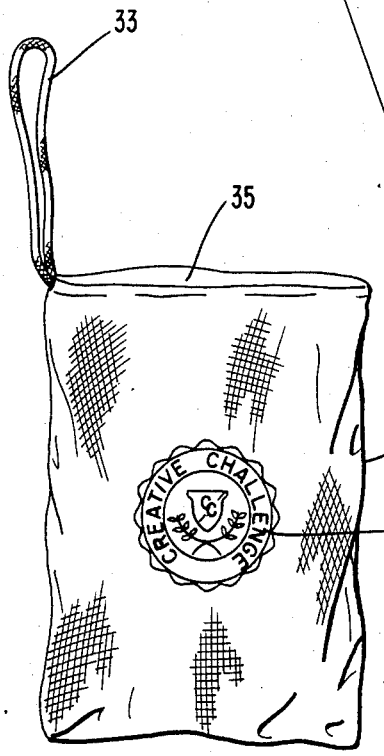
FIG. 3 shows a front view of the bag which may be utilized in the present invention.

With reference to FIG. 3, it is seen that the bag 19 may include a string 33 which may be pulled to tighten the opening 35 therein. Further, the bag 19 may have printed thereon a logo 37 identifying the subject game.

Now, with the components of the inventive game having been described, the manner of playing the game will now be set forth.

In a first manner of playing the subject game, where at least four players are available, the players are divided up into teams of two players each. The mat 31 is removed from the box and placed over a table and containers 15 of creative material are chosen by each team. If desired, each of the containers 15 of creative material may contain material of a unique color so that each team may play with a color of creative material different from that of the creative material used by other players.

The deck 27 of cards is then placed in the bag 19 and the bag is shaken until the cards are thoroughly mixed. The timer 23 is removed from the box 10 and is set for a predetermined time such as, for example, 30 seconds. The first player selects a card out of the bag and without showing it to their partner, places the card aside face down. The timer is started and the player who has seen the card begins to model with the creative material in an attempt to model out of the creative material that which is depicted on the card. When the timer indicates that the time period has elapsed, the partner has a predetermined time which may be governed by the timer in which to identify that which has been modeled.

Alternatively, rather than using a timer period for guessing that which has been modeled, the creator of the object may answer "yes" or "no" to a predetermined number of questions or guesses. If the object or creature is identified either within the time period for identification or after the predetermined number of guesses, that team scores one point. If not, no points are scored.

The game progresses from team to team and when a team has second and subsequent turns, the roles of the partners are sequentially reversed.

After a plurality of turns for each team of, alternatively, after a predetermined total game time has elapsed, the amount of points scored by each team is totaled and the team with the most points is declared the winner.

Two other methods of playing the inventive game may be employed when the game is played by teams of partners. In a first further method, the timer is started and the creator begins to create the object or creature with the guessor beginning to guess. When the object or creature is correctly guessed, the amount of time which has elapsed is noted on a score sheet. After a predetermined number of complete rounds have been played, each team's times are totalled and the lowest time wins.

In a second further method, all teams are divided into creators and guessors, a card is drawn from the bag and shown to all creators, and then all creators begin simultaneously to create the object or creature. The guessors may look at all versions of the object or creature which are being simultaneously created by the creators, and the first guessor to guess the object or creature scores a point for his or her team. After reversing roles back and forth and playing a predetermined number of rounds, the team with the most points wins the game.

In a situation where only two people are playing the game, as the players alternatie, one player creates the object or creature and the other player must identify it. In each turn, after one player finishes modeling, the other player must guess that which has been modeled. If the guessor correctly guesses the object or creature, they receive one point and the creator receives two points. The play goes back and forth for a predetermined number of turns or during a predetermined time period whereupon the points scored by each player are totaled.

So that the game may be fairly played and so that the play is uniform, several rules are required as follows:

(1) The player modeling is restricted to modeling only during the predetermined time period, when a timer is used.

(2) The modelers may only use their hands and fingernails and no extraneous objects may be used to model.

(3) During the time during which the modeling is being undertaken, the modeler may not speak.

(4) The modeler may only nod "yes" or "no" to guesses when that mode is used and may not write out any identifying markings as to the identification of the object or creature in the modeling material.

(5) The object or creature so modeled may not be picked up off the table for clues by the creator thereof. For example, if the object modeled is a telephone, the modeler may not place it next to the ear to aid in identifying.

(6) All modeling must be undertaken upon the table mat 31.

Accordingly, a game has been described hereinabove which fulfills each and every one of the objects as set forth hereinabove and provides fun and entertainment for long periods of time and for as many people as is desired. Various changes, modifications and alterations in the teachings of the present invention may be contemplated by those skilled in the art without departing from the intended spirit and scope thereof. Accordingly, it is intended that the present invention only be limited by the terms of the following claims.

I claim:

1. A game apparatus for a plurality of players comprising:

(a) a deck of cards, each card of said deck identifying an object or creature;

(b) modeling material which may be used to create a depiction of an object or creature shown on one of said cards;

(c) a timing mechanism;

(d) whereby each player of said game may, during their turn, pick a particular card and thereafter create a depiction of the object or creature depicted on said particular card out of said modeling material and during a predetermined time period as set by said timing mechanism; and (e) further wherein another of said players must identify said depiction.

2. The invention of claim 1, further including a game box for carrying said game apparatus and wherein said players are divided into teams of two players each and, during the turn of a particular team, one player thereof creates said depiction and the other player thereof attempts thereafter to identify said depiction.

3. The invention of claim 2 wherein said game box includes recesses for all game components and a handle to facilitate the carrying of said game apparatus in said box.

4. The invention of claim 1, wherein said modeling material comprises modeling clay.

5. The invention of claim 1, further including a bag into which said cards may be placed and from which a card may be randomly drawn by a player during their turn.

6. The invention of claim 1, further including a mat on which said depiction is created with said modeling material.

* * * * *